US008998402B2

(12) United States Patent
Kawaguchi et al.

(10) Patent No.: US 8,998,402 B2
(45) Date of Patent: Apr. 7, 2015

(54) PRINTING APPARATUS

(75) Inventors: Koichiro Kawaguchi, Yokohama (JP); Toshiki Takeuchi, Tokyo (JP); Kengo Nieda, Kawasaki (JP); Shigeru Toriihara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 13/348,430

(22) Filed: Jan. 11, 2012

(65) Prior Publication Data

US 2012/0194613 A1 Aug. 2, 2012

(30) Foreign Application Priority Data

Jan. 27, 2011 (JP) ..... 2011-015401

(51) Int. Cl.
*B41J 2/165* (2006.01)
*B41J 11/00* (2006.01)
*B41J 3/54* (2006.01)

(52) U.S. Cl.
CPC ..... *B41J 11/005* (2013.01); *B41J 3/543* (2013.01); *B41J 11/0025* (2013.01); *B41J 11/0065* (2013.01)

(58) Field of Classification Search
None
See application file for complete search history.

(56) References Cited

U.S. PATENT DOCUMENTS

| | | | | |
|---|---|---|---|---|
| 6,805,427 | B2 * | 10/2004 | Hosono | 347/31 |
| 2007/0109387 | A1 * | 5/2007 | Tanabe | 347/104 |
| 2007/0132799 | A1 | 6/2007 | Ilda | |

FOREIGN PATENT DOCUMENTS

| | | | |
|---|---|---|---|
| JP | 2007-152885 | A | 6/2007 |
| JP | 2008-001480 | A | 1/2008 |
| JP | 2009-006655 | A | 1/2009 |
| JP | 2009-039982 | A | 2/2009 |

* cited by examiner

*Primary Examiner* — Alejandro Valencia
(74) *Attorney, Agent, or Firm* — Canon USA Inc IP Division

(57) ABSTRACT

A printing apparatus includes a print head for inkjet printing, and a guide disposed opposing the print head and configured to guide a back surface of a sheet being conveyed in a first direction. The back surface is a reverse surface of a surface being printed. The printing apparatus further includes a receiving unit disposed opposing the print head and configured to receive ink outside the sheet being conveyed, and a mechanism configured to change a position of the guide in a second direction relative to the receiving unit being fixed, according to a size of the sheet to be used. The second direction crosses the first direction.

10 Claims, 9 Drawing Sheets

PRINTING APPARATUS

BACKGROUND OF THE INVENTION

1. Field of the Invention

The present invention relates to a printing apparatus configured to print data on a moving sheet.

2. Description of the Related Art

US Patent Application Publication 2007/0132799 discusses a technique relating to printing the data even on the edges of a sheet without generating blank spaces by an inkjet printing apparatus using a continuous sheet, i.e., so-called borderless printing. Since apart of ink is ejected even beyond the edges of a sheet during the borderless printing, movable ink receivers (90A and 90B) are provided outside a sheet to receive the ejected ink. The movable ink receivers and transport guides (92A and 92B) for supporting the edges of the sheet are configured to be displaced according to the width of the sheet to be used.

In the apparatus discussed in US Patent Application Publication 2007/0132799, the movable ink receivers and the transport guides are moved integrally with each other. However, it is not easy to quickly move the movable ink receivers due to their great masses and large volumes compared to the transport guides. Therefore, each time the width of a sheet is changed, a waiting time must be taken, which is required to move the movable ink receivers, thereby hindering the improvement of the total print throughput. Especially, when this printing technique is employed in a printing apparatus using a plurality of line heads, the size of a drive mechanism for moving the movable ink receivers increases.

SUMMARY OF THE INVENTION

The present invention is directed to realizing an improvement of the print throughput and a size reduction of a printing apparatus capable of performing borderless printing.

According to an aspect of the present invention, a printing apparatus includes a print head for inkjet printing, and a guide disposed opposing the print head and configured to guide a back surface of a sheet being conveyed in a first direction. The back surface is a reverse surface of a surface being printed. The printing apparatus further includes a receiving unit disposed opposing the print head and configured to receive ink outside the sheet being conveyed, and a mechanism configured to change a position of the guide in a second direction relative to the receiving unit being fixed, according to a size of the sheet being used. The second direction crosses the first direction.

According to the present invention, the printing apparatus, which is capable of performing borderless printing, is configured such that the ink receiving unit is fixed while the guide is moved as necessary, so that it is possible to realize an improvement of the throughput and a size reduction of the printing apparatus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinafter, an exemplary embodiment of a printing apparatus based on the inkjet printing method will be described. The printing apparatus according to the present exemplary embodiment is a high-speed line printer using a continuous sheet wound into a rolled shape and capable of producing both a two-sided print output and a one-sided print output. For example, this printing apparatus is suitable to the field of printing of a large number of sheets in a print lab. The present exemplary embodiment can be applied to a printing apparatus such as a printer, a multifunction peripheral including the printing function, a copying machine, and a facsimile apparatus. Further, the present exemplary embodiment can be widely applied to not only a printing apparatus but also various kinds of apparatuses such as an industrial instrument (for example, a manufacturing apparatus and an inspection apparatus used during manufacturing of various kinds of devices) used in a factory.

Figure 1:
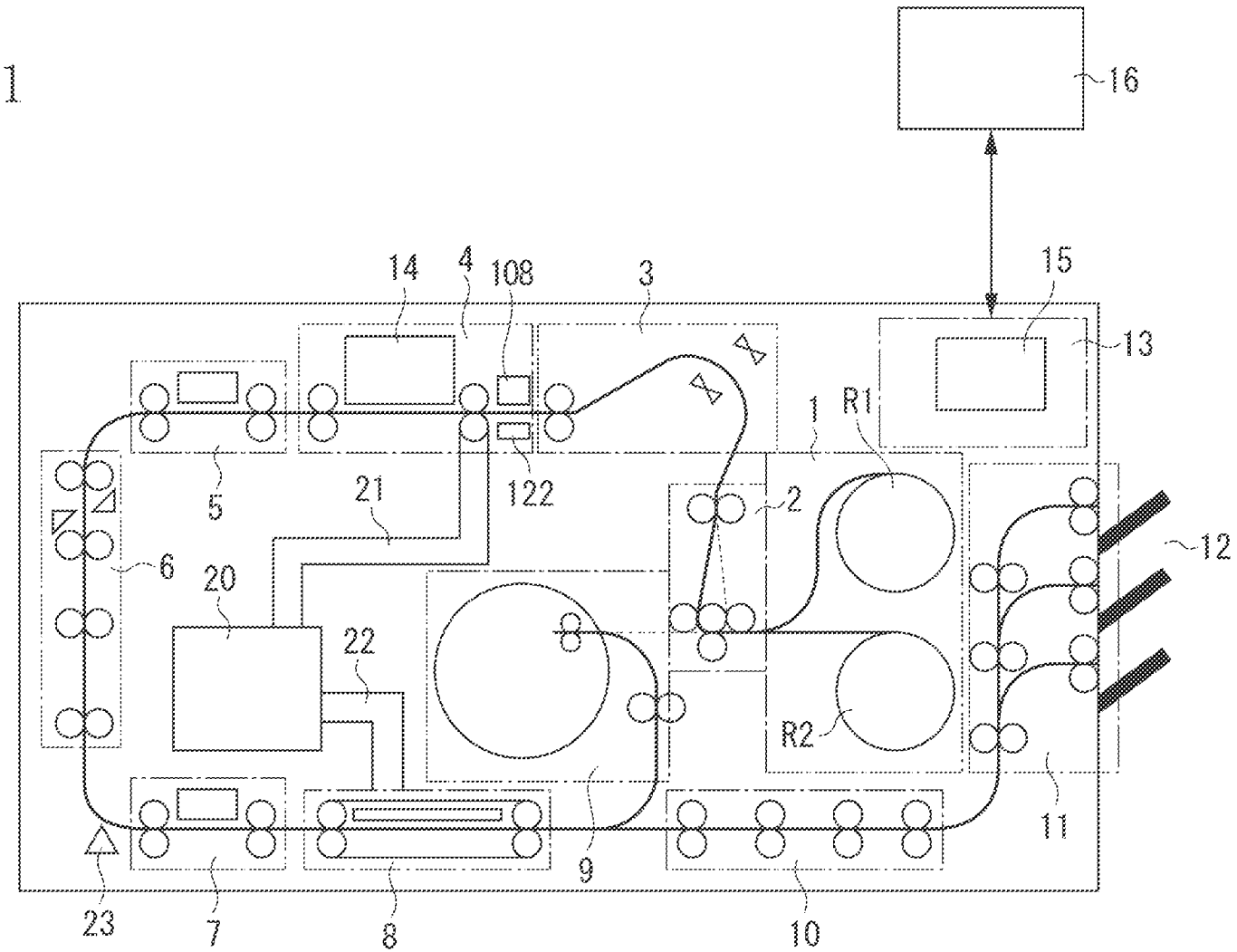
FIG. 1 schematically illustrates an internal configuration of a printer.

FIG. 1 is a cross-sectional view schematically illustrating an internal configuration of the printing apparatus. The printing apparatus according to the present exemplary embodiment uses a sheet wound into a rolled shape, and can perform two-sided printing on a first surface of the sheet and a second surface of the sheet, which is a back surface of the first surface. As an internal configuration, the printing apparatus generally includes a sheet feeding unit 1, a decurl unit 2, a skew correction unit 3, a printing unit 4, an inspection unit 5, a cutter unit 6, an information recording unit 7, a drying unit 8, a reversing unit 9, a discharge conveyance unit 10, a sorter unit 11, a discharge unit 12, a humidification unit 20, and a control unit 13. A sheet is conveyed along a sheet conveyance path indicated by the solid line in FIG. 1 by a conveyance mechanism including roller pairs and belts, and undergoes processing at the respective units. The terms "upstream" and "downstream" will be used herein to describe an arbitrary position along the sheet conveyance path from a position where a sheet is fed to a position where the sheet is discharged, in such a manner that a position closer to the sheet feeding unit 1 is referred to as "upstream" and a position farther away from the sheet feeding unit 1 is referred to as "downstream".

The sheet feeding unit 1 is a unit for holding and feeding a continuous sheet wound into a rolled shape. The sheet feeding unit 1 can contain two rolls R1 and R2, and is configured to selectively pull out and feed one of them. The number of rolls that the sheet feeding unit 1 can contain is not limited to two, and the sheet feeding unit 1 may be able to contain only one roll, or three or more rolls.

The decurl unit 2 is a unit for reducing a curl (warpage) of a sheet fed from the sheet feeding unit 1. The decurl unit 2 conveys a sheet while curving the sheet so as to provide a warpage in a direction opposite to the curl with use of two pinch rollers for one drive roller to thereby exert a decurl force to reduce the curl.

The skew correction unit 3 is a unit for correcting a skew state (tilting relative to an originally determined forward direction) of a sheet transported from the decurl unit 2. The skew correction unit 3 corrects a skew state of a sheet by pressing the sheet edge on the side, which is used as a basis of the correction, against a guide member.

The printing unit 4 is a sheet processing unit for forming an image by performing print processing onto a surface of a sheet being conveyed, from above by print heads 14. The printing unit 4 also includes a plurality of conveyance rollers for conveying a sheet. The print heads 14 include line print heads with inkjet nozzles array formed thereon, extending across a range covering a maximum width of sheets to be used as a recording medium. The printing unit 4 prints data on a continuous sheet by the line printing method.

As the print heads 14, a plurality of print heads is arranged in parallel with one another along the conveyance direction. In the present exemplary embodiment, seven print heads are provided corresponding to seven colors of cyan (C), magenta (M), yellow (Y), light cyan (LC), light magenta (LM), gray (G), and black (K). The number of colors and the number of print heads are not limited to seven. Further, as the inkjet printing method, the printing apparatus according to the present exemplary embodiment may employ, for example, the method using a heating element, the method using a piezoelectric element, the method using an electrostatic element, and the method using a Micro Electro Mechanical Systems (MEMS) element. Ink of each color is supplied from an ink tank to the print head 14 through a corresponding ink tube.

The inspection unit 5 is a unit for optically reading by a scanner an inspection pattern or image, which is printed by the printing unit 4 onto a sheet, to inspect, for example, the nozzle state of the print heads 14, the sheet conveyance state, and the image position, and determine whether an image is correctly printed. The scanner includes a Charge Coupled Device (CCD) image sensor or a Complementary Metal Oxide Semiconductor (CMOS) image sensor.

The cutter unit 6 is a unit including a mechanical cutter for cutting a printed sheet into a piece having a predetermined length. The cutter unit 6 also includes a plurality of conveyance rollers for sending a sheet to the next stage.

The information recording unit 7 is a unit for recording print information (unique information) such as a serial number and/or a print date of a print output on an unprinted area of a cut sheet. This recording is performed by printing a character and a code by the inkjet printing method or the thermal transfer method. A sensor 23 for detecting the leading edge of a cut sheet is disposed at a position upstream of the information recording unit 7 and downstream of the cutter unit 6. This means that the sensor 23 detects the edge of a sheet between the cutter unit 6 and the recording position of the information recording unit 7. The information recording unit 7 records information at the timing controlled based on the detection timing of the sensor 23.

The drying unit 8 is a unit for heating a sheet printed at the printing unit 4 to dry the provided ink in a short time. Within the drying unit 8, hot wind is applied to a sheet passing through the unit at least from the bottom surface side, thereby drying the surface with ink provided thereon. The drying method here is not limited to applying hot wind. The drying unit 8 may dry a sheet surface by emitting electromagnetic waves (for example, ultraviolet ray or infrared ray) onto a sheet surface.

The sheet conveyance path from the sheet feeding unit 1 to the drying unit 8 described above is referred to as "first path". The first path is shaped to have a U-turn between the printing unit 4 and the drying unit 8, and the cutter unit 6 is located at some position along the U-turn shape.

The reversing unit 9 is a unit for temporarily taking up a continuous sheet with data printed on the front surface to turn over the sheet during two-sided printing. The reversing unit 9 is disposed at some position along a path (loop path) (referred to as "second path") from the drying unit 8 to the printing unit 4 via the decurl unit 2 so as to supply a sheet transferred from the drying unit 8 to the printing unit 4 again. The reversing unit 9 includes a take-up rotator (drum) configured to rotate to take up a sheet. An uncut continuous sheet after printing of the front surface is temporarily taken up by the take-up rotator. After the take-up is finished, the take-up rotator is rotated in the reverse direction so that the taken up sheet is supplied to the decurl unit 2, and is then sent to the printing unit 4. Since this sheet is turned upside down, the printing unit 4 can print data on the back surface of the sheet. More specific details of the two-sided printing operation will be described later.

The discharge conveyance unit 10 is a unit for conveying a sheet cut by the cutter unit 6 and dried by the drying unit 8 to transfer the sheet to the sorter unit 11. The discharge conveyance unit 10 is disposed at a path (referred to as "third path") different from the second path where the reversing unit 9 is disposed. A path switching mechanism having a movable flapper is disposed at a path branching position to selectively guide a sheet conveyed along the first path to one of the second path and the third path.

The sorter unit 11 and the discharge unit 12 are disposed at a position at the side of the sheet feeding unit 1 and at the end of the third path. The sorter unit 11 is a unit for sorting printed sheets into groups as necessary. The sorted sheets are discharged onto the discharge unit 12 including a plurality of trays. In this way, the third path is laid out so as to extend below the sheet feeding unit 1 to discharge a sheet to the side opposite to the printing unit 4 and the drying unit 8 across the sheet feeding unit 1.

The humidification unit 20 is a unit for generating humidification gas (air) to supply it between the print heads 14 of the printing unit 4 and a sheet. This operation can prevent ink of the nozzles of the print heads 14 from drying. As the humidification method, the humidification unit 20 may employ, for example, the evaporative method, the spray mist method, and the steam method. Examples of types of the evaporative method include the moisture permeable membrane method, the drop pervaporation method, and the capillary method, besides the rotation method employed in the present exemplary embodiment. Examples of types of the spray mist method include the ultrasound method, the centrifugal method, the high-pressure spray method, and the two-fluid spray method. Examples of types of the steam method include the steam pipe method, the electric heating method, and the electrode method. The humidification unit 20 is connected to the printing unit 4 through a first duct 21, and is further connected to the drying unit 8 through a second duct 22. The drying unit 8 generates humid and hot gas when drying a sheet. This gas is introduced into the humidification unit 20 through the second duct 22, and is used as assist energy when the humidification unit 20 generates humidification gas. Then, the humidification gas generated by the humidification unit 20 is introduced to the printing unit 4 through the first duct 21.

The control unit 13 is a unit in charge of control of each unit of the entire printing apparatus. The control unit 13 includes a central processing unit (CPU), a storage apparatus, a controller (control unit) including various kinds of control units, an external interface, and an operation unit 15 where a user receives and outputs data. The operation of the printing apparatus is controlled based on an instruction from the controller or a host apparatus 16 such as a host computer connected to the controller via the external interface.

Figure 2:
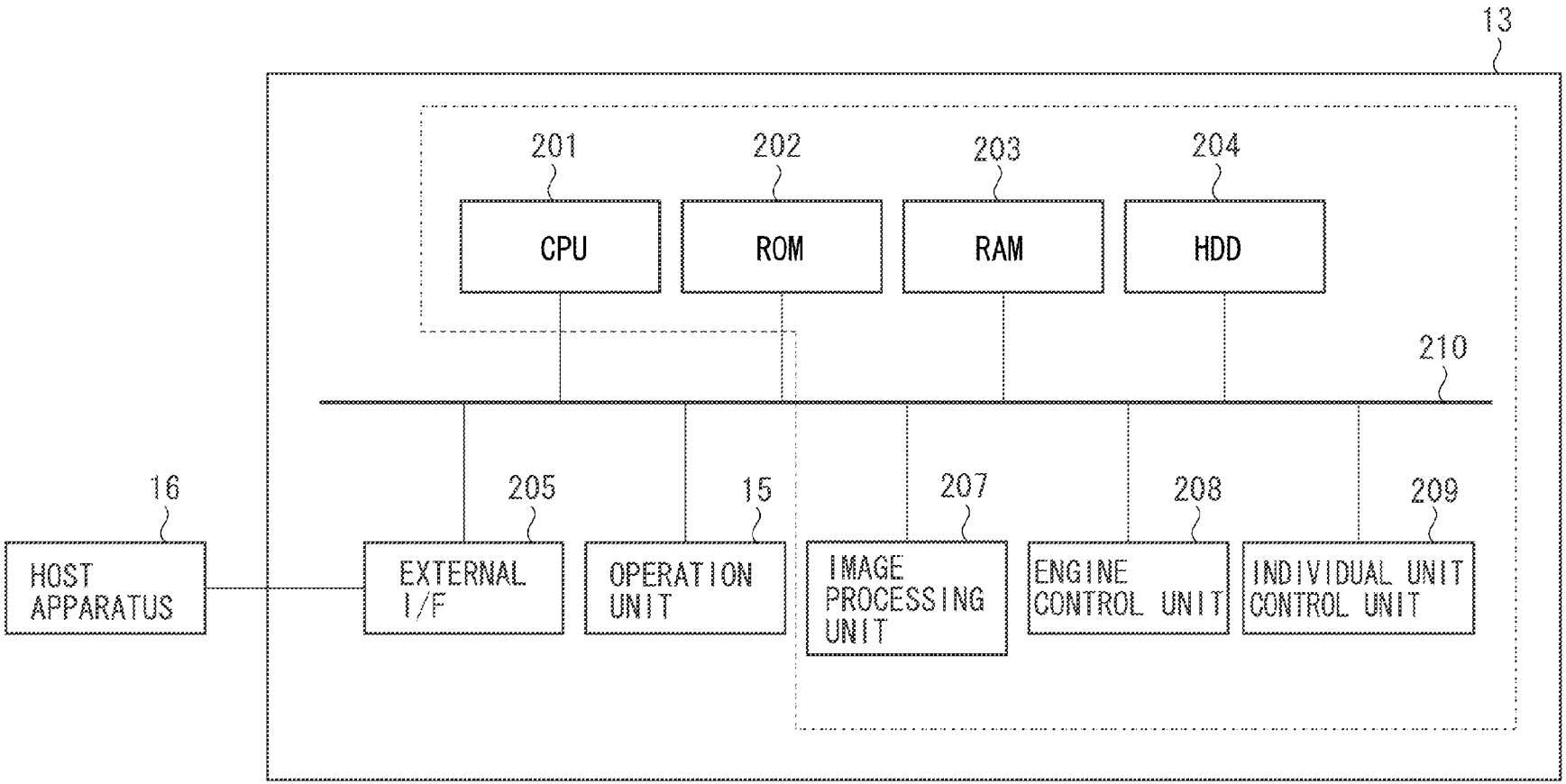
FIG. 2 is a block diagram of a control unit.

FIG. 2 is a block diagram illustrating the concept of the control unit 13. The controller (the range surrounded by the broken line) included in the control unit 13 is constituted by a CPU 201, a read only memory (ROM) 202, a random access memory (RAM) 203, a hard disc drive (HDD) 204, an image processing unit 207, an engine control unit 208, and individual unit control units 209. The CPU 201 (central processing unit) centrally controls the operations of each unit of the printing apparatus. The ROM 202 stores programs to be executed by the CPU 201, and fixed data required for various kinds of operations of the printing apparatus. The RAM 203 is used as a work area of the CPU 201, a temporary storage area of various kinds of received data, and an area for storing various kinds of setting data. The HDD 204 (hard disc) can store programs to be executed by the CPU 201, print data, and setting information required for various kinds of operations of the printing apparatus, and allow those data pieces to be read out from the HDD 204.

The operation unit 15 is an input/output interface with a user, and includes an input unit such as hard keys and a touch panel, and an output unit such as a display, which shows information, and an audio generator. For example, a display equipped with a touch panel may be used to provide a user with a display of, for example, the operational status, the print status, and the maintenance information (for example, a remaining ink amount, a remaining sheet amount, and a maintenance status) of the apparatus. A user can input various kinds of information from the touch panel.

A dedicated processing unit is provided to a unit that is required to perform data processing at a high speed. The image processing unit 207 applies image processing to print data handled by the printing apparatus. The image processing unit 207 converts the color space (for example, a luminance (Y), a blue-difference chrominance component (Cb), and a red-difference chrominance component (Cr)) of input image data into a commonly-used Red/Green/Blue (RGB) color space (for example, the standard RGB (sRGB) color space). Further, the image processing unit 207 applies various kinds of image processing such as a resolution conversion, an image analysis, and an image correction to image data as necessary. The print data acquired by these kinds of image processing is stored in the RAM 203 or the HDD 204. The engine control unit 208 drives and controls the print heads 14 of the printing unit 4 according to print data based on a control command received from, for example, the CPU 201. Further, the engine control unit 208 controls the conveyance mechanisms of each unit in the printing apparatus.

The individual unit control units 209 are sub controllers for individually controlling the sheet feeding unit 1, the decurl unit 2, the skew correction unit 3, the inspection unit 5, the cutter unit 6, the information recording unit 7, the drying unit 8, the reversing unit 9, the discharge conveyance unit 10, the sorter unit 11, the discharge unit 12, and the humidification unit 20. The individual unit control units 209 control the operations of the respective units based on an instruction from the CPU 201. The external interface 205 is an interface (I/F) for enabling a connection of the controller to the host apparatus 16, and is a local I/F or a network I/F. The constituent elements mentioned above are connected to one another through a system bus 210.

The host apparatus 16 is an apparatus that serves as a supply source of image data that the printing apparatus prints according to an instruction. The host apparatus 16 may be either a general-purpose computer or a dedicated computer. Alternatively, the host apparatus 16 may be a dedicated image device such as an image capture including an image reader unit, a digital camera, and a photo storage. In a case where the host apparatus 16 is a computer, an operating system (OS), application software for generating image data, and a printer driver for the printing apparatus are installed in a storage apparatus of this computer. It should be noted that the realization of all of the above-described processing by means of software is not an integral feature of the present exemplary embodiment, and a part or all of the above-described processing may be realized by means of hardware.

Next, a basic operation performed during printing will be described. The printing apparatus differently operates in one-sided printing and two-sided printing, and therefore both the one-sided printing operation and the two-sided printing operation will be described, respectively.

Figure 3A:
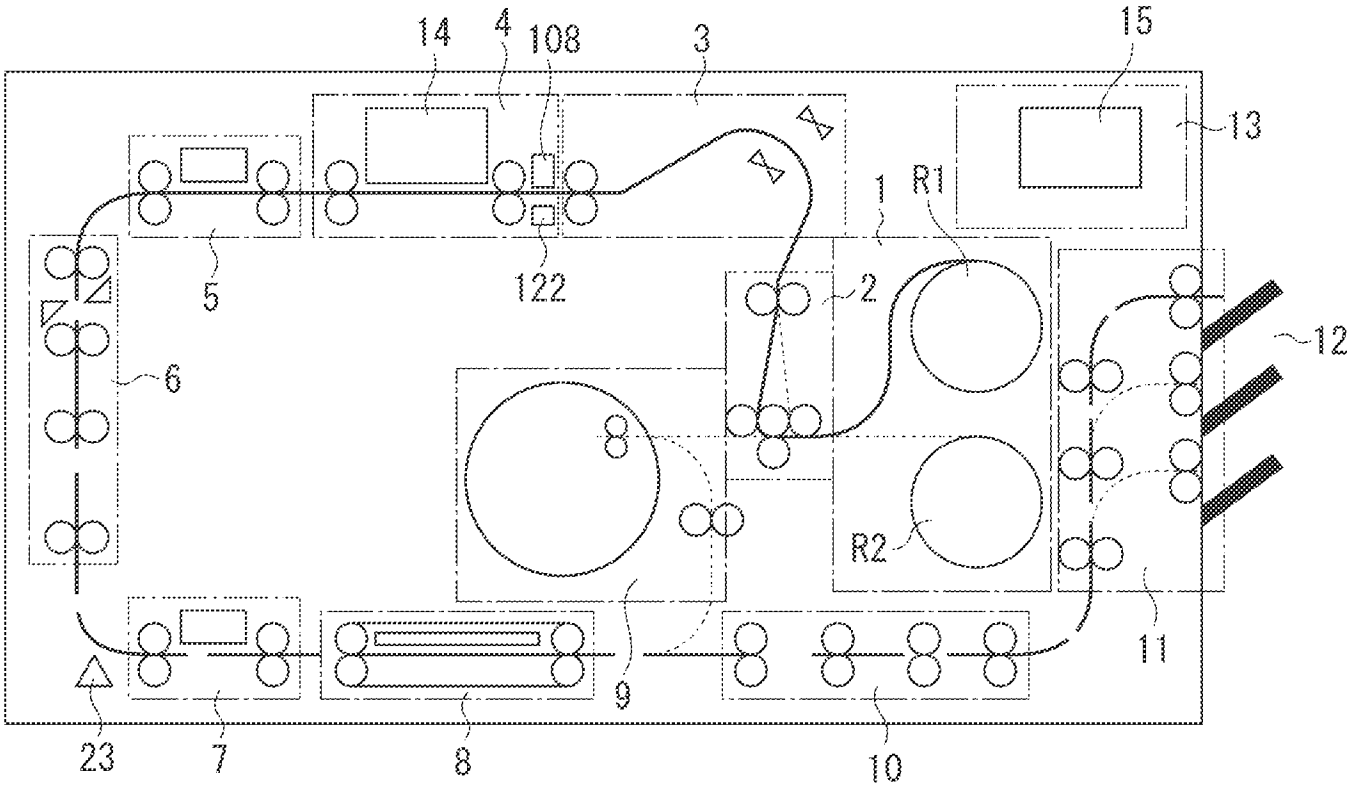
FIGS. 3A and 3B illustrate an operation of a one-sided printing mode and an operation of a two-sided printing mode, respectively.

FIG. 3A illustrates how the printing apparatus operates during one-sided printing. The thick solid line in FIG. 3A indicates the conveyance path from when a sheet is supplied from the sheet feeding unit 1 until the sheet is discharged to the discharge unit 12 after printing of the sheet. The sheet feeding unit 1 supplies a sheet, and the decurl unit 2 and the skew correction unit 3 apply respective processing to the sheet. Then, the printing unit 4 prints data onto the front surface of the sheet. After that, the inspection unit 5 inspects the printed sheet, and the cutter unit 6 cuts the printed sheet per predetermined unit length which is set in advance. The information recording unit 7 records the print information onto the back surface of the cut sheet when necessary. Then, the cut sheet is conveyed to the drying unit 8 one by one to be dried there. After that, the sheet is sequentially discharged and stacked on the tray 12 of the sorter unit 11 through the discharge conveyance unit 10.

Figure 3B:
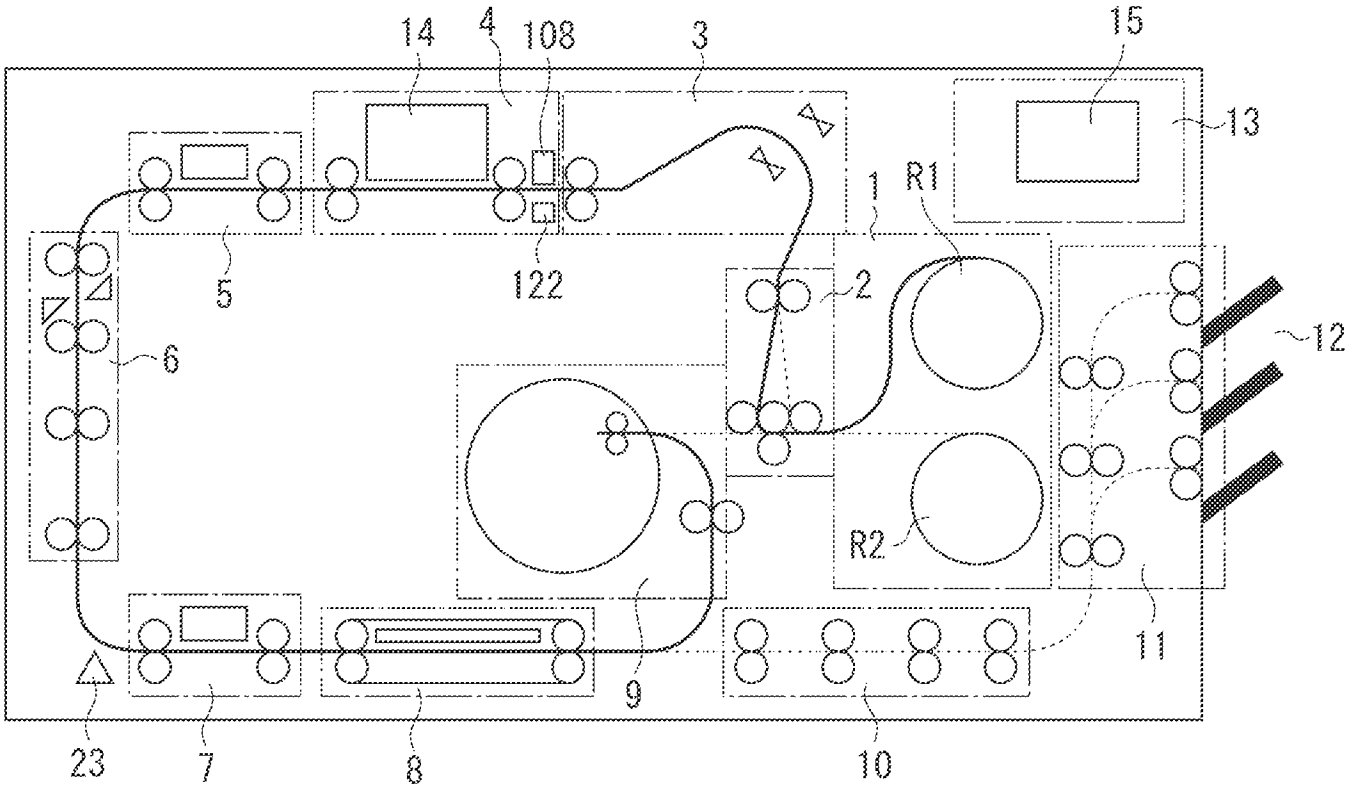

FIG. 3B illustrates how the printing apparatus operates during two-sided printing. For two-sided printing, the printing apparatus executes a front-surface print sequence, and after that executes a back-surface print sequence. In the front-surface sequence, which the printing apparatus executes first, each unit from the sheet feeding unit 1 to the inspection unit 5 operates in the same manners as the operations for the above-described one-sided printing. The cutter unit 6 does not cut the sheet, and therefore the sheet is conveyed to the drying unit 8 as a continuous sheet.

After the ink on the surface is dried at the drying unit 8, the sheet is introduced to the path leading to the reversing unit 9 instead of the path leading to the discharge conveyance unit 10. The introduced sheet is taken up by the take-up drum of the reversing unit 9 which rotates in the forward direction (the counterclockwise direction as viewed in FIG. 3B). After the printing unit 4 completes printing all of data to be printed onto the front surface, the cutter unit 6 cuts the continuous sheet at the trailing edge of the printed area of the continuous sheet. Based on this cut position, the printed portion of the continuous sheet at the downstream side in the conveyance direction is transported through the drying unit 8, and is all taken up by the reversing unit 9 until the trailing edge of the cut position is wound around the take-up drum. On the other hand, the portion of the continuous sheet at the upstream side of the cut position in the conveyance direction is wound up around the sheet feeding unit 1 again so as to prevent the leading edge of the sheet (the cut position) from remaining at the decurl unit 2.

After the above-described sequence for front-surface printing, the operation is switched to the sequence for back-surface printing. The take-up drum of the reversing unit 9 starts to rotate in a direction (the clockwise direction as viewed in FIG. 3B) opposite to the direction at the time of taking up the sheet. The edge of the wound sheet (the trailing end of the sheet when the sheet is taken up becomes the leading edge of the sheet when the sheet is sent out) is sent into the decurl unit 2. The decurl unit 2 corrects a curl in a direction opposite to the direction at the time of the front-surface sequence. This is because the sheet around the take-up drum is wound in a state turned upside down compared to the sheet wound into a roll at the sheet feeding unit 1, so as to have a curl in the opposite direction.

After that, the sheet is transported to the printing unit 4 through the skew correction unit 3, and then the printing unit 4 prints data onto the back surface of the continuous sheet.

After that, the printed sheet is transported to the cutter unit 6 through the inspection unit 5, and then the cutter unit 6 cuts the printed sheet per predetermined unit length which is set in advance. Since the cut sheet has data printed on both the front surface and the back surface, the information recording unit 7 does not record any information on the sheet at this time. The cut sheet is conveyed to the drying unit 8 one by one, and is sequentially discharged and stacked onto the tray 12 of the sorter unit 11 through the discharge conveyance unit 10.

Figure 4:
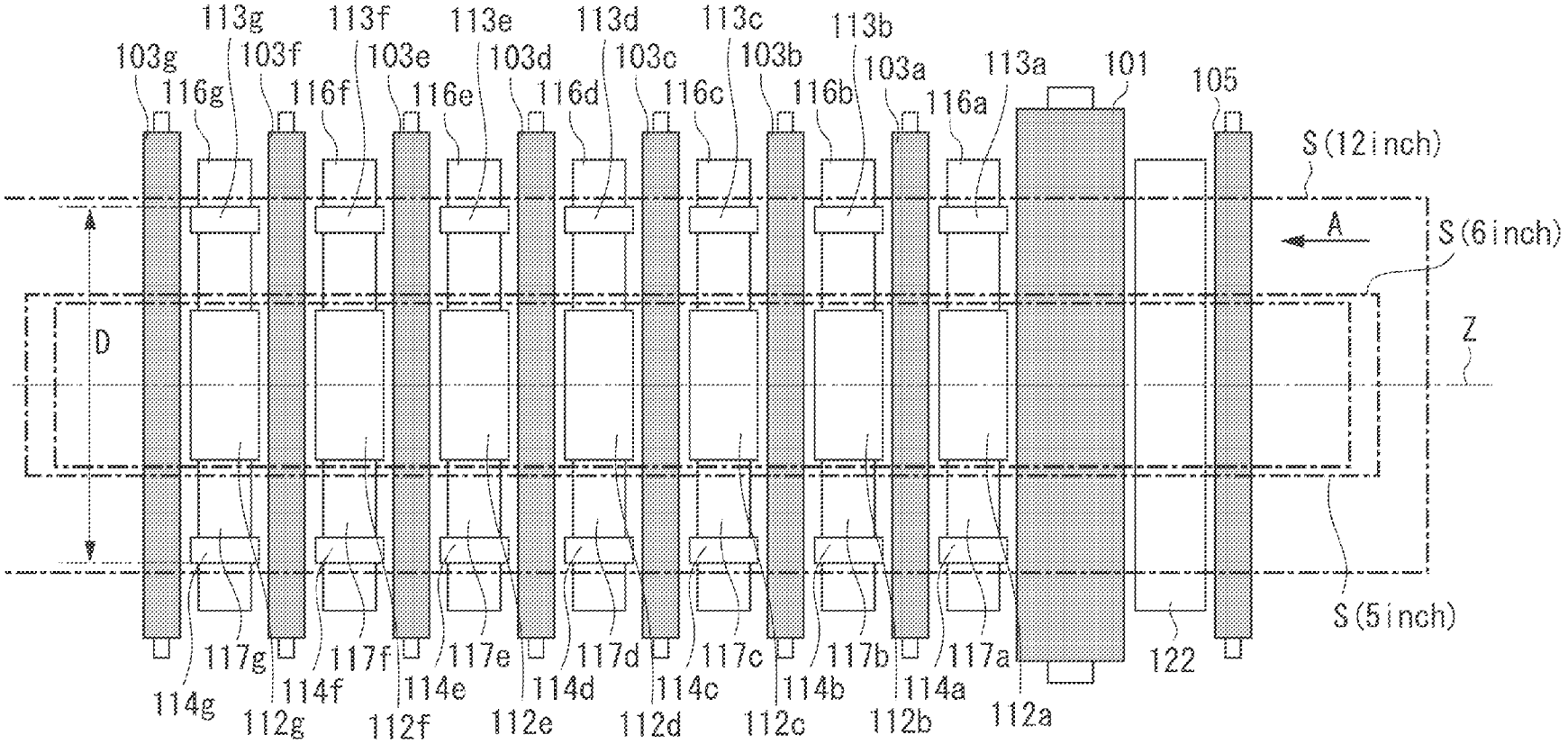
FIG. 4 is a top view illustrating a configuration of a printing unit, mainly focusing on a sheet conveyance mechanism thereof.
Figure 5:
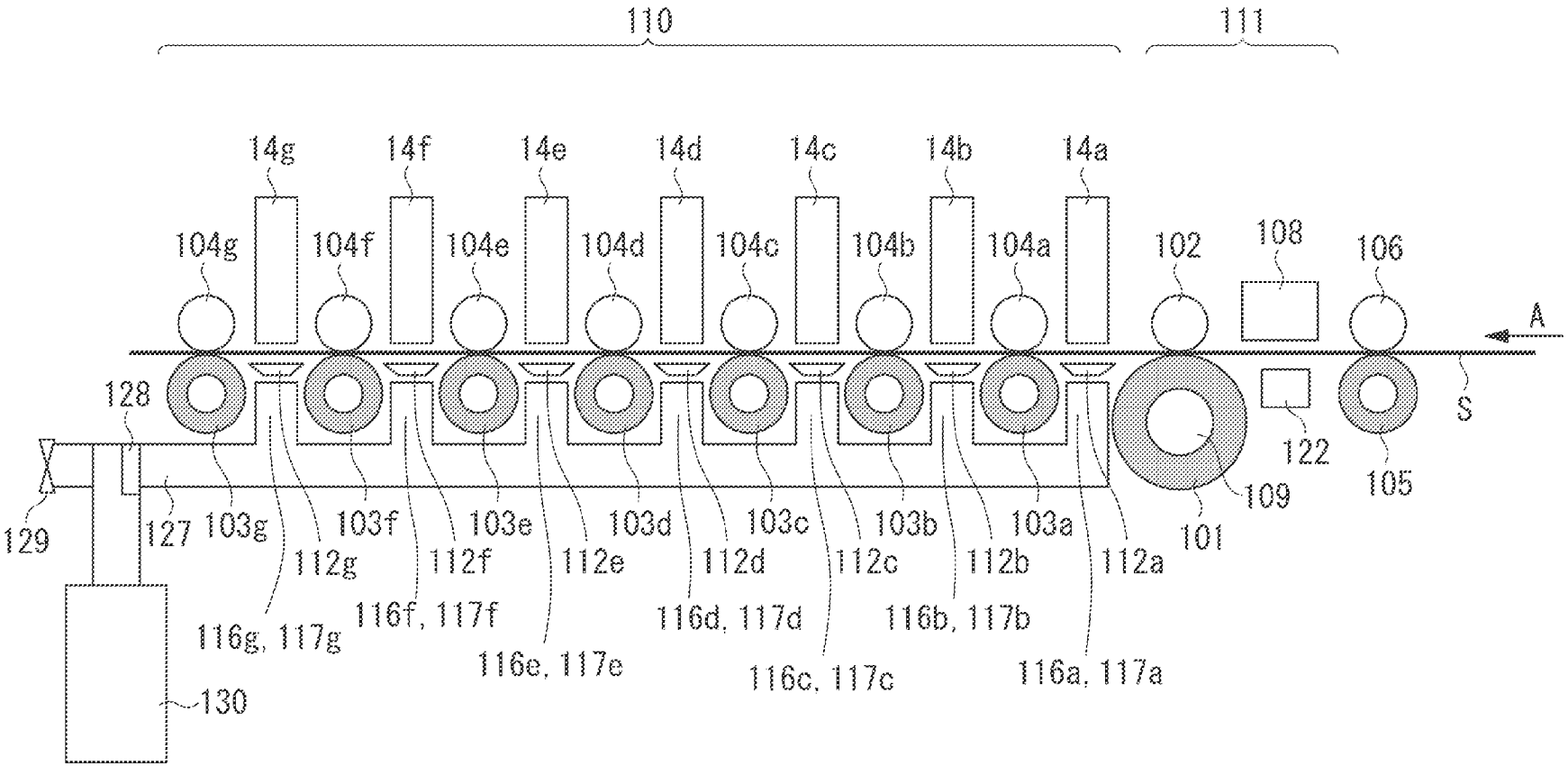
FIG. 5 is a cross-sectional view illustrating the configuration of the printing unit, mainly focusing on the sheet conveyance mechanism thereof.

Next, the printing unit 4 will be described in further detail. FIGS. 4 and 5 are a top view and a cross-sectional view illustrating a configuration of the printing unit 4, mainly focusing on the sheet conveyance mechanism thereof. At the printing unit 4, a sheet S, which is a continuous sheet, is conveyed by three kinds of roller pairs, a first roller pair, a second roller pair, and a third roller pair in the direction indicated by the arrow A in FIGS. 4 and 5. The first roller pair is constituted by a conveyance roller 101, which has a drive force, and a pinch roller 102, which is driven to rotate. The second roller pair refers to each of roller pairs (seven pairs) constituted by a plurality of conveyance rollers 103*a* to 103*g*, which have a drive force, and a plurality of pinch rollers 104*a* to 104*g*, which are driven to rotate. The third roller pair is constituted by a conveyance roller 105, which has a drive force, and a pinch roller 106, which is driven to rotate. The conveyance roller 101 is provided with a rotary encoder 109 for detecting the rotational state of the roller.

Seven line print heads 14*a* to 14*g*, which respectively correspond to the seven colors, are arranged in a print region 110 downstream of the first conveyance roller pair along a sheet conveyance direction (a first direction). The line print heads 14*a* to 14*g* and the pinch rollers 104*a* to 104*g* are arranged alternately one by one. Fixed guides 112*a* to 112*g* are disposed at positions respectively opposite to the print heads 14*a* to 14*g*, and function to guide and introduce the sheet S. Two kinds of movable guides 113*a* to 113*g* and 114*a* to 114*g* are disposed at both two sides of each fixed guide 112*a* to 112*g* in a sheet width direction (a second direction) crossing (perpendicular to) the first direction. These fixed guides 112*a* to 112*g* and movable guides 113*a* to 113*g* and 114*a* to 114*g* are provided to ensure that the leading edge of a sheet can reach the roller pair located downstream during an introduction of the sheet, even if the sheet has a curled portion. During a printing operation, the fixed guides 112*a* to 112*g* and the movable guides 113*a* to 113*g* and 114*a* to 114*g* do not contact a sheet being conveyed. In other words, a sheet is stretched to extend between the front and back roller pairs to establish a sheet conveyance configuration without a support of a guide from below the sheet.

The sheet S is sandwiched between the roller pairs at both the front and back sides in each position opposing the print heads 14*a* to 14*g* at short intervals, so that the motion of the sheet S is stabilized during the sheet conveyance. When the sheet S is introduced first, the leading edge of the sheet S is transported through a plurality of nip positions at short intervals while being guided by the fixed guides 112*a* to 112*g* and the movable guides 113*a* to 113*g* and 114*a* to 114*g*, thereby realizing a stabilized sheet introduction.

A direct sensor 108 is a non-contact type optical sensor configured to acquire information regarding the movement state (the moving speed or the moved distance) of a sheet, directly from the sheet by measuring the surface of the sheet. A measurement position 111 is located between the nip position of the first roller pair and the nip position of the third roller pair. The direct sensor 108 acquires the information regarding the movement state of a sheet by measuring the surface of the sheet at the measurement position 111. In the present exemplary embodiment, the direct sensor 108 is a laser Doppler sensor. The laser Doppler sensor is a speed sensor configured to measure a moving speed and a moved distance by emitting a laser beam to a moving surface and catching a Doppler shift. Since more details of the structural and measurement principle of the laser Doppler sensor are widely known from the disclosure of Japanese Patent Application Laid-Open No. 2009-6655 and other documents, the descriptions thereof will be omitted herein.

The direct sensor 108 can be another non-contact type optical sensor rather than the laser Doppler sensor. For example, the direct sensor 108 may be using an image sensor (a CCD image sensor or a CMOS image sensor). This type of direct sensor acquires a plurality of image data by imaging the surface of a moving sheet by a fixed image sensor at different sequential timing. Then, this direct sensor acquires the movement state (the moving distance and the moving speed) of the sheet by comparing the image data pieces according to, for example, the pattern matching method. As still another embodiment, the direct sensor 108 may be a contact type sensor in which the sensor surface physically contacts the surface of the sheet S.

A mark reader 122 is disposed opposing the direct sensor 108 across the sheet S at the measurement position 111. The mark reader 122 reads a mark formed on the first surface of the sheet S from the back side of the measurement position 111 where the director sensor 108 measures the sheet S. The mark reader 122 includes a light source (for example, a white light emitting diode (LED)) configured to irradiate a sheet surface, and a light receiver such as a photodiode or an image sensor configured to detect each RGB component of light reflected by the irradiated sheet surface. The mark reader 122 can read a mark based on a change in the signal level of the light receiver or an image analysis of the captured data. The mark reader 122 is used to read the mark indicating the image position formed on the first surface of the sheet S, thereby aligning the image of the back surface with the image of the front surface, when the printing apparatus prints the image on the back surface in the above-described two-sided printing mode.

As illustrated in FIG. 5, ink receiving units 116*a* to 116*g* and 117*a* to 117*g* are disposed opposing print heads 14*a* to 14*g*. The ink receiving units 116*a* to 116*g* and 117*a* to 117*g* are configured as recessed holes elongated in the sheet width direction so as to receive ink in the holes. The respective ink receiving units 116*a* to 116*g* and 117*a* to 117*g* are connected to a common collection duct 127. A fan 129 is disposed at the end of the collection duct 127 so as to perform air suction from the respective ink receiving units 116*a* to 116*g* and 117*a* to 117*g* through the collection duct 127. This suction operation enables an effective collection of ink mist floating in the air and ink flung outside a sheet from the ink receiving units 116*a* to 116*g* and 117*a* to 117*g*. A filter 128, which is made of a sponge, and a waste tank 130 are disposed between the fan 129 and the ink receiving units 116*a* to 116*g* and 117*a* to 117*g*. The filter 128 traps collected ink. The waste fluid tank 130 collects the ink trapped by the filter 128. The collection duct 127 may be arranged so as to be slightly inclined downwardly toward the waste fluid tank 130 to facilitate an ink flow to the waste fluid tank 130. When ink accumulates in the waste fluid tank 130 due to long use, a user detaches the waste fluid tank 130 from the printing apparatus, and disposes of the tank.

Figure 6:
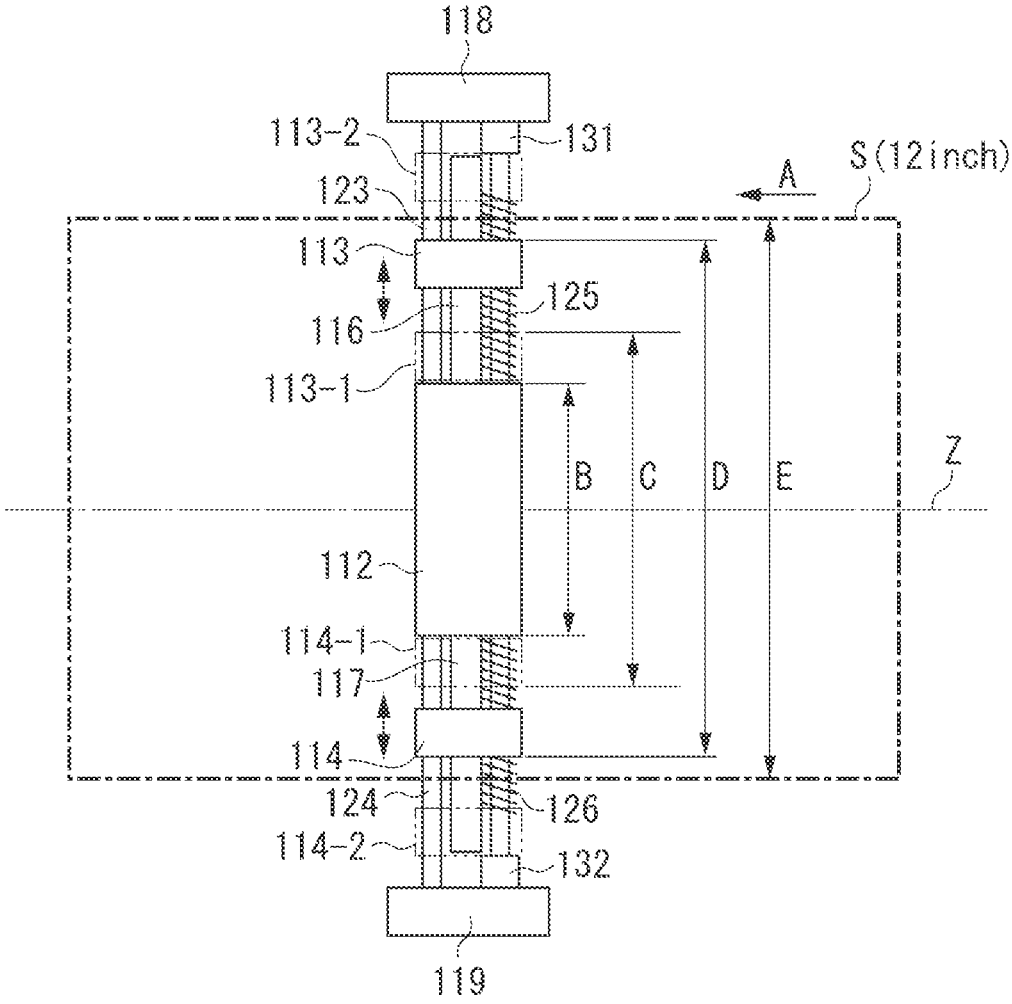
FIG. 6 is a top view illustrating a configuration of a drive mechanism for moving movable guides.

FIG. 6 is a top view illustrating a configuration of a drive mechanism for moving the movable guides 113*a* to 113*g* and 114*a* to 114*g*. All drive mechanisms at the seven positions have the same configuration, and one of them will be arbitrarily described now. One movable guide 113 is guided moving in the sheet width direction by a mechanism including a lead screw 125 and a guide shaft 123. The other movable guide 114 is guided moving in the sheet width direction by a mechanism including a lead screw 126 and a guide shaft 124. The lead screw 125 displaces the movable guide 113 by rotating in response to a drive force from a drive source 118 (a movable guide motor 303 illustrated in FIG. 7). The lead screw 126 moves the movable guide 114 by rotating in response to a drive force from a drive source 119 (the movable guide motor 303 illustrated in FIG. 7). The guide shafts 123 and 124, and the lead screws 125 and 126 are shifted from the ink receiving units 116 and 117 opposing the nozzles of the print head 14, in both of the sheet conveyance directions, so that a direct contact with ejected ink can be avoided.

A compression spring 131 is fixed outside the lead screw 125, and a compression spring 132 is fixed outside the lead screw 126. When the movable guides 113 and 114 are moved outward to reach positions 113-2 and 114-2 indicated by the broken lines in FIG. 6, the movable guides 113 and 114 abut on the springs 131 and 132. The lead portions (the spiral grooves of the guide screws) of the lead screws 125 and 126 are formed to extend slightly beyond these positions, and the movable guides 113 and 114 can be moved outward from the positions 113-2 and 114-2 only a short distance while the movable guides 113 and 114 are compressing the compression springs 131 and 132. The movable guides 113 and 114 cannot be moved further outward even when the lead screws 125 and 126 are rotated. The movable guides 113 and 114 are moved inward by rotations of the lead screws 125 and 126 in the opposite directions. The compression springs 131 and 132 push the movable guides 113 and 114 to ensure engagement of the movable guides 113 and 114 with the lead portions of the lead screws 125 and 126.

In this way, the drive mechanism includes a region where drive transmission is blocked so as to prevent the movable guides 113 and 114 from moving beyond a predetermined range. In other words, a predetermined movable range can be acquired by forming the lead portions of the lead screws 125 and 126 within a limited range. This configuration can eliminate the necessity of preparing a sensor for detecting the positions of the movable guides 113 and 114. Since it is unnecessary to use a sensor at a position where the sensor may be easily contaminated by ink, the excellent reliability of the printing apparatus can be maintained for a long time. Further, since it is unnecessary to adjust a plurality of movable guides to align their phases at the time of assembling the parts of the printing apparatus, the assemblability can be improved. The respective lead screws 125 and 126 at the seven positions are usefully driven by a common drive source. Use of a common drive source can eliminate the necessity of assembling the parts while aligning the phases of the lead screws 125 and 126 at the time of constructing the printing apparatus, so that the assemblability can be further improved.

Figure 7:
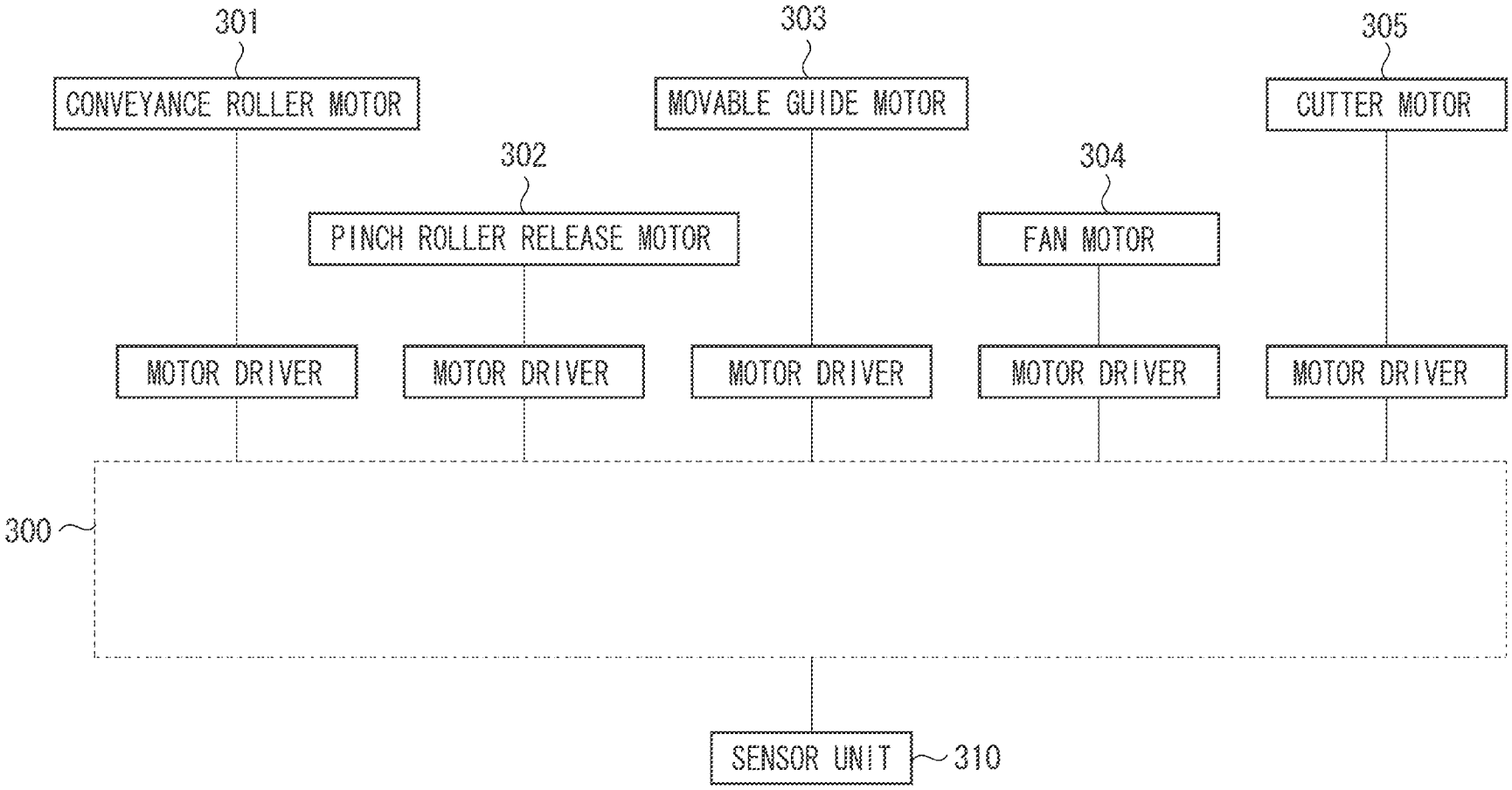
FIG. 7 is a block diagram illustrating a system configuration of a control system for controlling various kinds of motors.

FIG. 7 is a block diagram illustrating a system configuration of a control system which controls driving of various kinds of motors included in the conveyance mechanism. A controller 300 is connected to a conveyance roller motor 301, a pinch roller release motor 302, a movable guide motor 303, a fan motor 304, and a cutter motor 305 through respective motor drivers. Various kinds of sensors for detecting the state of the printing apparatus are collectively indicated as a sensor unit 310. The controller 300 controls driving of the various kinds of motors through the motor drivers based on a detection result from the sensor unit 310.

The printing apparatus according to the present exemplary embodiment allows use of various sheet sizes, among which the minimum sheet width is 5 inches and the maximum sheet width is 12 inches. Further, the printing apparatus also allows selection of sheets having sheet widths of 6 inches, 8 inches, and 10 inches as intermediate sizes between the minimum size and the maximum size. The printing apparatus according to the present exemplary embodiment is expected to process these five kinds of differently sized sheets, and sheets of these sizes are fed to the printing unit 4 in such a manner that the centers thereof are aligned based on the center line (the chain line Z illustrated in FIGS. 4 and 6) in the sheet width direction, i.e., the sheets are fed to the printing unit 4 according to the so-called center alignment setting.

The standard positions of the movable guides 113 and 114 are as illustrated in FIG. 6, and are located slightly inward from the outer ends of the sheet S having a width of 12 inches. A distance D between the outer ends of the movable guides 113 and 114 corresponding to a distance E of 12 inches (=304.8 mm) is 299.8 mm. When the two movable guides 113 and 114 are located at these positions, it can be ensured that the movable guides 113 and 114 are positioned inside the sheet edges, even in consideration of a tolerance of sheet width and tolerances of the positions of parts of the printing apparatus. On the other hand, the fixed guide 112 has a slightly narrower width B than the minimum sheet width, 5 inches. The width B is 122 mm, which is slightly narrower than 5 inches (=127 mm).

When the printing apparatus prints data on the sheet Shaving a sheet width of 12 inches, which is the maximum width among the widths of sheets expected to be used as a recording medium, the movable guides 113 and 114 are not displaced, staying at the standard positions. The central portion of the sheet S is guided by the fixed guide 112, and the edges of the sheet S are guided by the movable guides 113 and 114. Since a sheet has rigidity to some degree, this amount of a space between the fixed guide 112 and the movable guides 113 and 114 may not affect the guide function. In such a state that there is a sheet having the maximum sheet width (referred to as "first state"), both the two movable guides 113 and 114 are positioned behind the sheet and located so as not to be exposed outside the sheet as viewed from the direction of the print head 14. At this time, the ink receiving units 116 and 117 are exposed outside the sheet, so that the ink receiving units 116 and 117 can suck ink and ink mist flung outside the sheet during borderless printing.

Similarly, when the printing apparatus prints data on the sheet S having sheet widths of 5 inches and 6 inches, which are the minimum sheet widths among the widths of sheets expected to be used as a recording medium or 6 inches, the movable guides 113 and 114 are not displaced, either, staying at the standard positions. The sheet S is guided only by the fixed guide 112. For a sheet of 6-inch width, the ratio covered by the fixed guide 112 is reduced compared with a sheet of 5-inch width, but this amount of difference may not affect the guide function. In this way, in such a state that there is a sheet having the minimum sheet width (referred to as "second state"), both the two movable guides 113 and 114 are located so as to be exposed outside the sheet as viewed from the direction of the print head 14. At this time, the ink receiving units 116 and 117 are exposed between the movable guides 113 and 114, and the edges of the sheet, so that the ink receiving units 116 and 117 can suck ink and ink mist flung outside the sheet during borderless printing. The movable guides 113 and 114 are not displaced, staying at the same positions between the first state and the second state.

On the other hand, when the printing apparatus prints data on a sheet having a width of 8 inches or 10 inches, the movable guides 113 and 114 are moved before the sheet is introduced in the direction reducing the distance therebetween compared to the distance between the standard positions. In other words, the movable guides 113 and 114 are moved to more inner positions 113-1 and 114-1 indicated by the broken lines. A distance C between the outer ends of the movable guides 113 and 114 at this time is 198.2 mm which is slightly narrower than 8 inches (203.2 mm). In this state that there is a sheet having a predetermined sheet width which is narrower than the maximum sheet width and greater than the minimum sheet width (referred to as "third state"), both the two movable guides 113 and 114 are displaced to different positions from the positions in the first state. As viewed from the direction of the print head 14, the movable guides 113 and 114 are positioned behind the sheet and located so as not be exposed outside the sheet, while the ink receiving units 116 and 117 are exposed outside the sheet.

When the printing apparatus shifts from the first or second state to the third state, or from the third state to the first or second state, only the movable guides 113 and 114 which have small masses are moved, and the ink receiving units 116 and 117 which have great masses are fixed and are not moved. Therefore, even a small drive source can quickly complete the movements with only a slight reduction of the print throughput. Nevertheless, frequent switching of the sheet size may affect the throughput. However, if the printing apparatus is used for the purpose of photography printing, possible sizes are mainly 5 inches and 6 inches, which are standard photo sizes, and 12 inches, which is a standard album size. According to the printing apparatus of the present exemplary embodiment, changing a sheet between these sheet widths, no matter how frequent it is, does not cause movements of the movable guides 113 and 114, thereby preventing a reduction of the throughput.

In the present exemplary embodiment, a sheet is set based on the center alignment, so that the two movable guides 113 and 114 are moved centrally symmetrically according to the sheet width. Alternatively, in a case where a sheet is set based on the one-side alignment, the present exemplary embodiment can be applied by moving only one of the movable guides 113 and 114, and the other movable guide may be fixed. In this one-side alignment setting, one edge of a sheet is constantly placed at a same position by the fixed guide, and the one movable guide is moved according to the sheet width.

Figure 8:
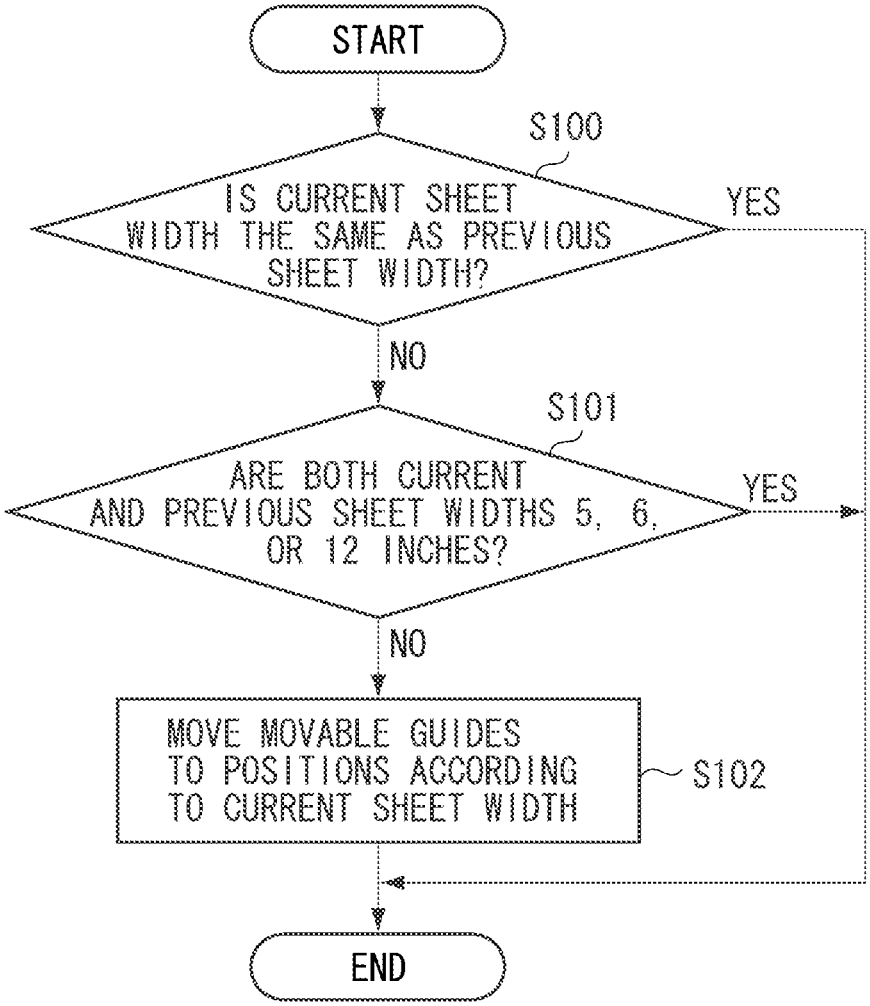
FIG. 8 is a flowchart illustrating a sequence for moving the movable guides.

FIG. 8 is a flowchart illustrating a sequence for moving the movable guides 113 and 114. In step S100, the controller 300 checks the size (the size in the sheet width direction) of a sheet that the printing apparatus uses, and determines whether this size is the same as the previously used size (YES), or not (NO). If the determination result is YES (the current size is the same as the previous size) (YES in step S100), the sequence is ended, since the controller 300 does not need to change the positions of the movable guides 113 and 114. If the determination result is NO (the current size is different from the previous size) (NO in step S100), the processing proceeds to step S101. In step S101, the controller 300 determines whether both the size of the sheet being currently used and the size of the sheet previously used are any of three kinds of widths, 5 inches, 6 inches, and 12 inches (YES), or not (NO). If the sheet size is changed among these three kinds of widths, the controller 300 does not need to change the positions of the movable guides 113 and 114. Therefore, if the determination result is YES (YES in step S101), the present sequence is ended.

If the determination result is NO (NO in step S101), the processing proceeds to step S102. In step S102, the controller 300 moves the two movable guides 113 and 114 to appropriate positions. More specifically, if the size of the sheet being currently used is any of the widths of 5 inches, 6 inches, and 12 inches, the controller 300 moves the movable guides 113 and 114 to the positions as illustrated in FIG. 6. As described above, at this time, the outer ends of the movable guides 113 and 114 are spaced apart from each other by the distance D (=299.8 mm). On the other hand, if the size of the sheet being currently used is either 8-inch width or 10-inch width, the controller 300 moves the movable guides 113 and 114 to the more inner positions 113-1 and 114-1 indicated by the broken lines. As described above, at this time, the outer ends of the movable guides 113 and 114 are spaced apart from each other by the distance C (=198.2 mm). This positional adjustment is applied to the movable guides 113 and 114 at all of the seven positions.

According to the printing apparatus described above, since the ink receiving units 116 and 117 are fixed while the lightweight movable guides 113 and 114 are moved as necessary, the movements can be completed in a shorter time, and achieved with use of only a small drive mechanism. Further, since the same positions are set as the positions of the movable guides 113 and 114 as to a plurality of predetermined sheet widths including the maximum size and the minimum size so that the movable guides 113 and 114 are not moved at the time of switching among printing operations, frequent change of the sheet size does not necessarily lead to frequent movements of the movable guides 113 and 114. As a result, it is possible to provide a printing apparatus capable of performing borderless printing while realizing the improvement of the print throughput and the reduction in the apparatus size. In addition, since ink mist is suck through the ink receiving units 116 and 117, it is possible to reduce the influence of ink mist during borderless printing, thereby producing a high-quality print output on a less contaminated sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-015401 filed Jan. 27, 2011, which is hereby incorporated by reference herein in its entirety.

What is claimed is:

1. A printing apparatus comprising:

a line-type print head having a nozzle array for inkjet printing extending along a first direction across a range covering a width of a sheet being used;

a movable guide unit disposed facing the print head and configured to guide a back surface of the sheet being conveyed in a second direction perpendicular to the first direction, wherein the back surface is a reverse side of a surface being printed by the print head, wherein the guide unit has a first movable guide and a second movable guide disposed corresponding to both sides in the first direction;

a receiving unit disposed under the guide unit and facing the print head, configured to receive ink discharged from the print head, the receiving unit extending to cover the nozzle array; and a mechanism configured to change positions of the first and the second movable guides in the first direction while the receiving unit is unmoved to change an interval between the first and the second movable guides according to a size of the sheet being used, wherein the mechanism has a first lead screw for moving the first movable guide and a second lead screw for moving the second movable guide and the first and the second lead screws are rotated independently by different motors, wherein, in a first state in which there is a sheet having a maximum sheet width assumed to be used, the guide unit is positioned behind the sheet and located so as not to be exposed outside the sheet while the receiving unit is exposed outside the sheet, as viewed from the print head, wherein, in a second state in which there is a sheet having a minimum sheet width assumed to be used, the first and the second movable guides are located so as to be exposed outside the sheet while the receiving unit is exposed between the first and the second movable guides and an edge of the sheet, as viewed from the direction of the print head, and wherein positions of the first and the second movable guides are set such that each of the first and the second movable guides are located at a same position in the first state and the second state.

2. A printing apparatus comprising:

a line-type print head having a nozzle array for inkjet printing extending along a first direction across a range covering a width of a sheet being used;

a movable guide unit disposed facing the print head and configured to guide a back surface of the sheet being conveyed in a second direction perpendicular to the first direction, wherein the back surface is a reverse side of a surface being printed by the print head, wherein the guide unit has a first movable guide and a second movable guide disposed corresponding to both sides in the first direction;

a receiving unit disposed under the first and the second movable guides and facing the print head, configured to receive ink discharged from the print head, the receiving unit extending to cover the nozzle array; and a mechanism configured to change positions of the first and the second movable guides in the first direction while the receiving unit is unmoved to change an interval between the first and the second movable guides according to a size of the sheet being used, wherein the mechanism has a lead screw and a motor, wherein, in a first state in which a sheet having a first sheet width being used, the first and the second movable guides are positioned behind the sheet and located so as not to be exposed outside the sheet while the receiving unit is exposed outside the sheet, as viewed from the print head, wherein, in a second state in which a sheet having a second sheet width that is smaller than the first sheet width being used, the first and the second movable guides are located so as to be exposed outside the sheet while the receiving unit is exposed between the first and the second movable guides and an edge of the sheet, as viewed from the direction of the print head, and wherein positions of the first and the second movable guides are set such that each of the first and the second movable guides are located at a same position in the first state and the second state.

3. The printing apparatus according to claim 2, wherein, in a third state in which a sheet having a third sheet width that is narrower than the first sheet width and greater than the second sheet width, the position of the first and the second movable guides are set such that each of the first and the second movable guides are displaced to a position different from the position in the first state, and the first and the second movable guides are positioned behind the sheet and located so as not to be exposed outside the sheet while the receiving unit is exposed outside the sheet, as viewed from the print head.

4. The printing apparatus according to claim 3, further comprising a fixed guide disposed between the first and the second movable guides while facing the print head, wherein the fixed guide has a narrower width than the first sheet width.

5. The printing apparatus according to claim 1, wherein a plurality of print heads is arranged along the first direction, and the guide and the receiving unit are disposed so as to correspond to each of the plurality of print heads.

6. The printing apparatus according to claim 1, wherein the drive mechanism includes a region where drive transmission is blocked so as to prevent the guide from moving beyond a predetermined range.

7. The printing apparatus according to claim 6, wherein the drive mechanism includes a lead screw having a lead portion formed within a limited range, and the guide is prevented from moving beyond the limited range even when the lead screw is rotated.

8. The printing apparatus according to claim 1, wherein the guide guides a leading edge of the sheet from the back surface side when the sheet is introduced, and does not contact the sheet during a printing operation.

9. The printing apparatus according to claim 1, wherein the receiving unit is under air suction.

10. The printing apparatus according to claim 1, wherein the print head is a line print head, and the printing apparatus prints images onto a continuous sheet by a line printing method.

* * * * *